US006353380B1

(12) United States Patent
Yu

(10) Patent No.: US 6,353,380 B1
(45) Date of Patent: Mar. 5, 2002

(54) POWER SWITCH DEVICE

(76) Inventor: Tsung-Mou Yu, No. 4, Alley 2, Lane 23, Sec. 3, Pa Te Road, Panchiao, Taipei (TW)

( * ) Notice: Subject to any disclaimer, the term of this patent is extended or adjusted under 35 U.S.C. 154(b) by 0 days.

(21) Appl. No.: 09/492,575

(22) Filed: Jan. 27, 2000

(51) Int. Cl.[7] ..... H01H 37/02; H01H 37/32; H01H 37/46

(52) U.S. Cl. ..... 337/37; 337/39; 337/59; 337/85; 337/112; 337/113; 337/66; 337/74

(58) Field of Search ..... 337/66–69, 333, 337/379, 59, 79, 76, 53, 74, 75, 91, 39, 85, 112, 113, 140, 334, 345; 200/553–557

(56) References Cited

U.S. PATENT DOCUMENTS

| | | | | | |
|---|---|---|---|---|---|
| 3,358,099 | A | * | 12/1967 | Bellomayre | 200/113 |
| 4,258,349 | A | * | 3/1981 | Flory | 337/46 |
| 4,345,233 | A | * | 8/1982 | Matthies | 337/75 |
| 4,528,538 | A | * | 7/1985 | Andersen | 337/43 |
| 4,931,762 | A | * | 6/1990 | Fierro | 337/66 |
| 4,937,548 | A | * | 6/1990 | Sdunek | 337/70 |
| 5,012,495 | A | * | 4/1991 | Munroe et al. | |
| 5,223,813 | A | * | 6/1993 | Cambreieng et al. | 337/66 |
| 5,262,748 | A | * | 11/1993 | Tsung-Mou | 337/66 |
| 5,451,729 | A | * | 9/1995 | Onderka et al. | 200/18 |
| 5,541,569 | A | * | 7/1996 | Jang | 337/68 |
| 5,760,672 | A | * | 6/1998 | Wang | 337/79 |
| 5,828,284 | A | * | 10/1998 | Huang | 337/37 |
| 5,847,638 | A | * | 12/1998 | Sorenson | 337/380 |
| 5,889,457 | A | * | 3/1999 | Hsu et al. | 337/59 |
| 5,892,426 | A | * | 4/1999 | Huang | 337/59 |
| 5,898,355 | A | * | 4/1999 | Yu | 337/8 |
| 6,072,381 | A | * | 6/2000 | Yu | 337/37 |
| 6,094,126 | A | * | 7/2000 | Sorenson | 337/37 |
| 6,121,868 | A | * | 9/2000 | Chiang | 337/37 |
| 6,154,116 | A | * | 11/2000 | Sorenson | 337/37 |

FOREIGN PATENT DOCUMENTS

| | | | | |
|---|---|---|---|---|
| CH | 647094 A5 | * | 12/1984 | 337/333 |
| DE | 19534611 A1 | * | 3/1996 | H01H/23/20 |
| EP | 0694947 A1 | * | 1/1996 | H01H/71/54 |

* cited by examiner

*Primary Examiner*—Leo P. Picard
*Assistant Examiner*—Anatoly Vortman

(57) ABSTRACT

A power switch device includes a switch body with a switch contact device pivotally connected to a switch cover body. An alloy piece is connected to one of two contact terminals and a second contact joint to which the other contact terminal disengagably contacts when the circuit is closed. The switch contact device has a movable member retractably received therein and the alloy piece contacts one end of the movable member. The end of the movable member is normally supported on a plate in the switch body so that when the current is overloaded, the alloy piece is thermally deformed to push the end of the movable member away from the plate and the switch contact device is therefore pivoted to release a conductive plate pressed by the switch contact device so as to shut the circuit.

4 Claims, 4 Drawing Sheets

POWER SWITCH DEVICE

FIELD OF THE INVENTION

The present invention relates to a switch structure, and more specifically, to a power switch with a switch contact device that is pivoted by the alloy element when the current is overloaded.

BACKGROUND OF THE INVENTION

Power switches with only two states of ON and OFF functions controlled manually have been widely used in many appliances. However, it is risky to use the above power switches when the power source is unstable because overheating may occur due to overloading of the appliance and the wire easily catches fire. Some improved power switches of the prior arts include an alloy element composed of more than one metal to automatically shut off the power source when the alloy element is thermally deformed because of overheating.

For example, the power switch disclosed in U.S. Pat. No. 5,786,742, U.S. Pat. No. 5,223,813, U.S. Pat. No. 4,937,548, U.S. Pat. No. 4,661,667, U.S. Pat. No. 4,931,762, U.S. Pat. No. 5,451,729, and U.S. Pat. No. 4,704,594. In U.S. Pat. No. 4,937,548, the device includes an alloy piece, a lever, and a cam actuator. The lever is actuated by the alloy piece, and the cam actuator is used to coordinate with a seesaw actuator. Thermal deformation of the alloy piece causes the lever to move, and then the cam actuator loses support, escapes and further cuts off the power source. Overheating may occur on the alloy piece. The above power switch uses the lever, the cam actuator, and the seesaw actuator to indirectly control the conductive plate, which is used to contact with the power source. The response of the power off operation in the above power switch when overheating occurs is so slow that the overloaded current may flow into the operating appliance in a short time to damage the appliance. Additionally, the conductive plate and the alloy piece need wires to connect with each other, and the whole structure is complicated to cause the manufacturing difficulties. The alloy piece has to actuate the seesaw actuator and the lever to escape. The function of automatic power off may incorrectly operate.

Furthermore, the power switch disclosed in U. S. Pat. No. 5,786,742 uses the thermal deformation of the alloy piece to push a limited position base such that a button can automatically escape and return back. The button is used to directly contact with the contact point of the power source so that the button may conduct the overloaded current when overheating occurs. The whole structure is still complicated. In summary, those improved power switches in the prior arts can partly overcome the danger of overheating for the appliance but the response is slow and the whole structure is complicated. An advanced power switch with simpler structure and a short response time is greatly desired.

The present invention intends to provide a power switch wherein the switch contact device includes a movable member supported on a plate when the poser switch is normally used, and the movable member is pushed away from the plate by the thermally deformed alloy element due to the overloading current to shut off the circuit immediately. The present invention intends to provide a power switch wherein the switch contact device includes a movable member supported on a plate when the poser switch is normally used, and the movable member is pushed away from the plate by the thermally deformed alloy element due to the overloading current to shut off the circuit immediately.

SUMMARY OF THE INVENTION

In accordance with one aspect of the present invention, there is provided a power switch device and comprising a switch body having a switch cover body pivotably engaged with an open top of the switch body. A contact reed is biased between one end of the switch cover body and the switch body. A first contact terminal and a second contact terminal are engaged with a bottom of the switch body. A support plate and a retaining pin respectively extend from an inside of the switch body. A seat is connected to the inside of the switch body and has a first contact joint. A conductive plate has one end thereof fixedly connected to the second contact terminal and the other end of the conductive plate has a second contact joint to contact the first contact joint.

An alloy piece has one of two protrusions thereof fixedly connected to the first contact terminal and the other protrusion of the alloy piece is connected to the seat. A switch contact device is pivotably connected to the switch cover body and has a shank and a head which is located on one end of the shank. The head has a slot defined therein and the retaining pin is located in the slot. A movable member is retractably received in the shank and a first distal end of the movable member contacts the alloy piece and a second distal end movably extends from the other end of the shank. The second distal end is supported on the support plate and will be removed from the support plate to let the switch contact device be pivoted to shut off the circuit when the alloy piece is thermally deformed.

The object of the present invention is to provide a power switch device that employs a movable member biased in a pivotable switch contact device and the switch contact device is connected to the switch cover body. When the alloy piece is deformed due to the current overloading, the switch contact device is pivoted to actuate the switch cover body to open the circuit immediately.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
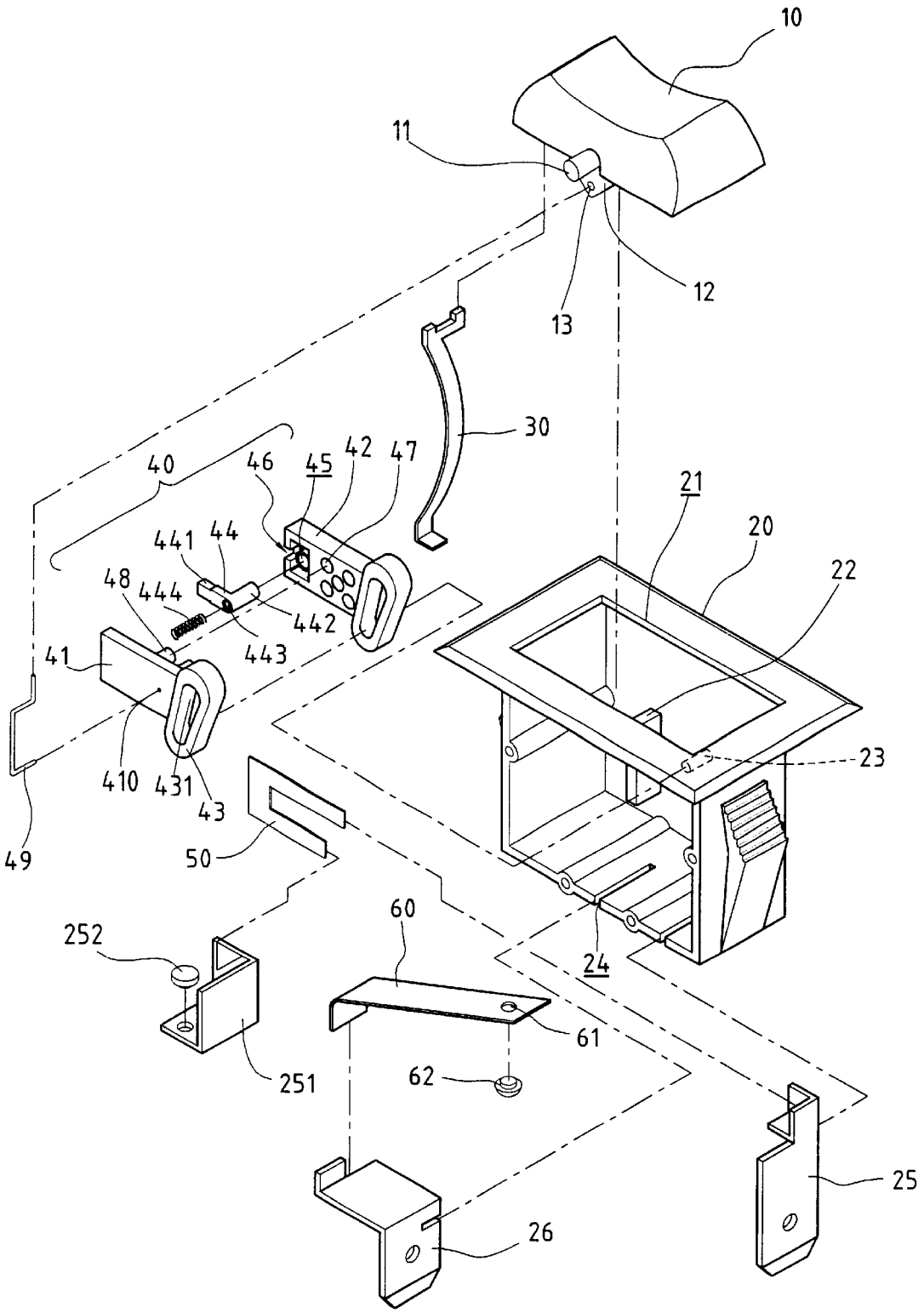
FIG. 1 is an exploded view to show a power switch device of the present invention.
Figure 2:
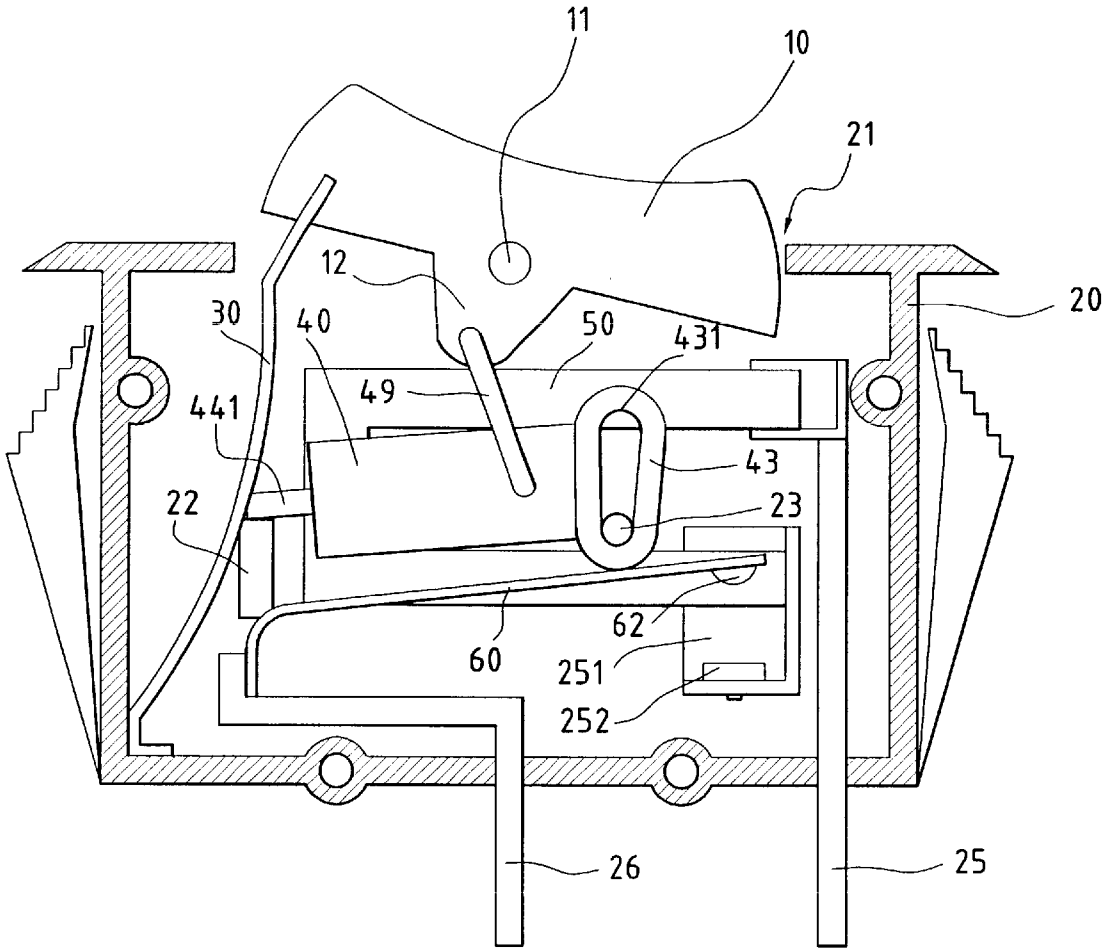
FIG. 2 is a side elevational view, partly in section, of the power switch device of the present invention, wherein the device is in its OFF state.

Referring to FIGS. 1 and 2, the power switch device in accordance with the present invention comprises a switch body 20 having an open top 21 and a bottom of the switch body 20 has two slits 24 defined therethrough. A first contact terminal 25 and a second contact terminal 26 are respectively engaged with the two slits 24. The first contact terminal 25 and a second contact terminal 26 each have one end received in the switch body 20, and the other end of each of the first contact terminal 25 and the second contact terminal 26 extends out from the bottom of the switch body 20 so as to be connected to electric appliance. A support plate 22 and a retaining pin 23 respectively extend from an inside of the switch body 20. A switch cover body 10 has a cambered surface on a top thereof and two fulcrums 11 extend from two sides of the switch cover body 10 so as to be pivotably engaged with the open top 21 of the switch body 20. A seat 251 is connected to the inside of the switch body 20 and has a first contact joint 252 connected thereon.

A conductive plate 60 has one end thereof fixedly connected to the second contact terminal 26 and the other end of the conductive plate 60 has a second contact joint 62 engaged with an aperture 61 defined through the conductive plate 60. The second contact joint 62 is located above the first contact joint 252 with a gap defined between the first contact joint 252 and the second contact joint 62.

A transverse U-shaped alloy piece 50 has two protrusions and one of the protrusions is fixedly connected to the first contact terminal 25 and the other protrusion of the alloy piece 50 is connected to the seat 251.

A switch contact device 40 has a shank and a head 43 which is located on one end of the shank. A link 49 is connected between a hole 410 in the shank and a hole 13 in a bridge portion 12 of the switch cover body 10. The head 43 has a oval slot 431 defined therein and the retaining pin 23 is located in the slot 431. The switch contact device 40 is composed of a first part 41 and a second part 42. The first part 41 has a plurality of tubes 48 extending from a cooperation surface thereof and toward the second part 42, the second part 42 having a plurality of holes 47 defined in a cooperation surface thereof so as to receive the tubes 48. The second part 42 has a recessed portion defined in the cooperation surface thereof and an aperture 45 is defined through a bottom defining the recessed portion A notch 46 is defined through a periphery of the recessed portion. An L-shaped movable member 44 is retractably received in the shank and a first distal end 442 of the movable member 44 extends through the aperture 45 and contacts the alloy piece 50. A second distal end 441 of the movable member 44 movably extends through the notch 46 of the shank. The second distal end 441 is normally supported on the support plate 22. A resilient member 444 is biased between the cooperation surface of the first part 41 and a recess 443 in a rear end of the first distal end 442 of the movable member 44 so as to urge the first distal end 442 out from the shank of the switch contact device 40.

A contact reed 30 has one end thereof connected to one end of the switch cover body 10 and the other end of the contact reed 30 is secured in the switch body 20. When the switch device is in its OFF position, the right end of the switch cover body 10 is pushed downward and the conductive plate 60 is not pressed by the head 43 of the switch contact device 40 as shown in FIG. 2.

Figure 3:
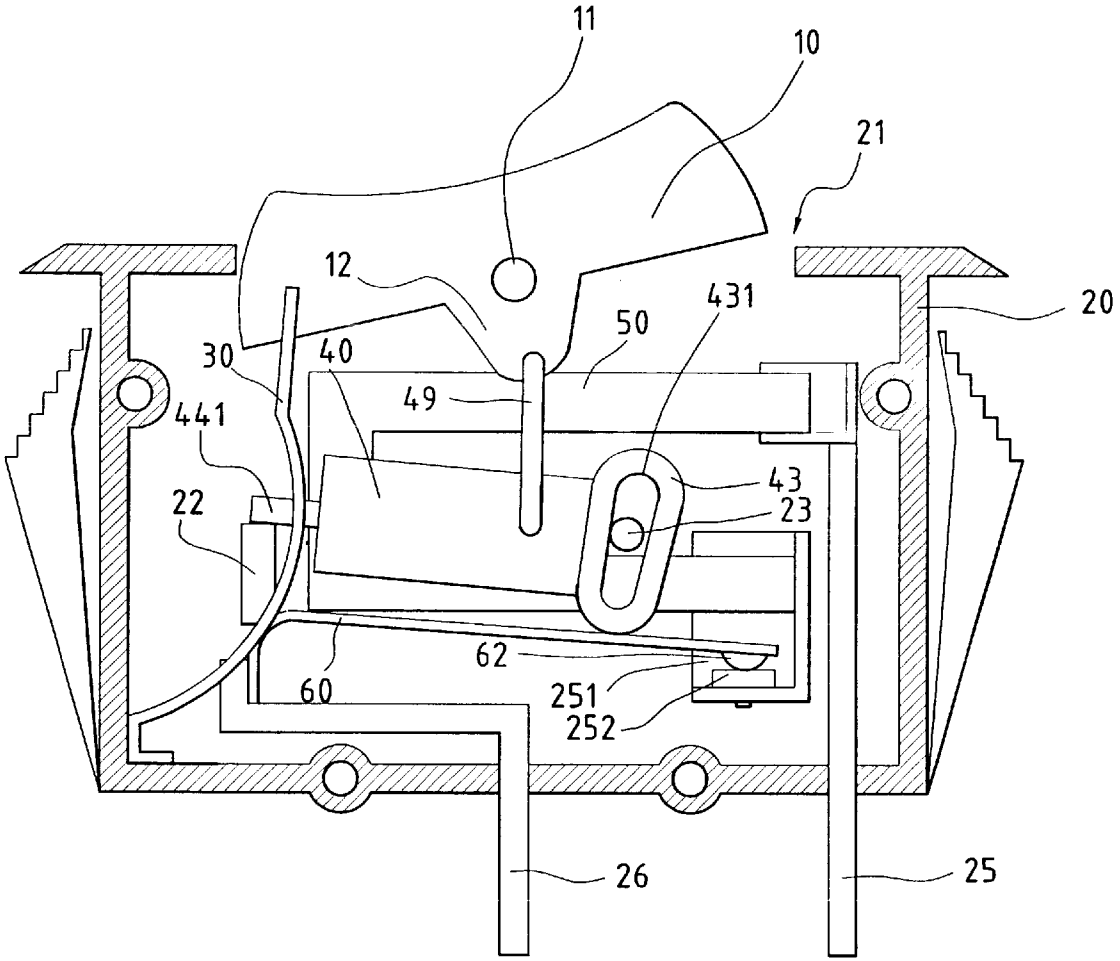
FIG. 3 is a side elevational view, partly in section, of the power switch device of the present invention, wherein the device is in its ON state.

As shown in FIG. 3, when the left end of the switch cover body 10 is pushed, the switch contact device 40 is pivoted by the movement of the link 49 so that the head 43 is moved to push the conductive plate 60 to let the first contact joint 252 contacts the second contact joint 62. The circuit is ON at this position.

Figure 4:
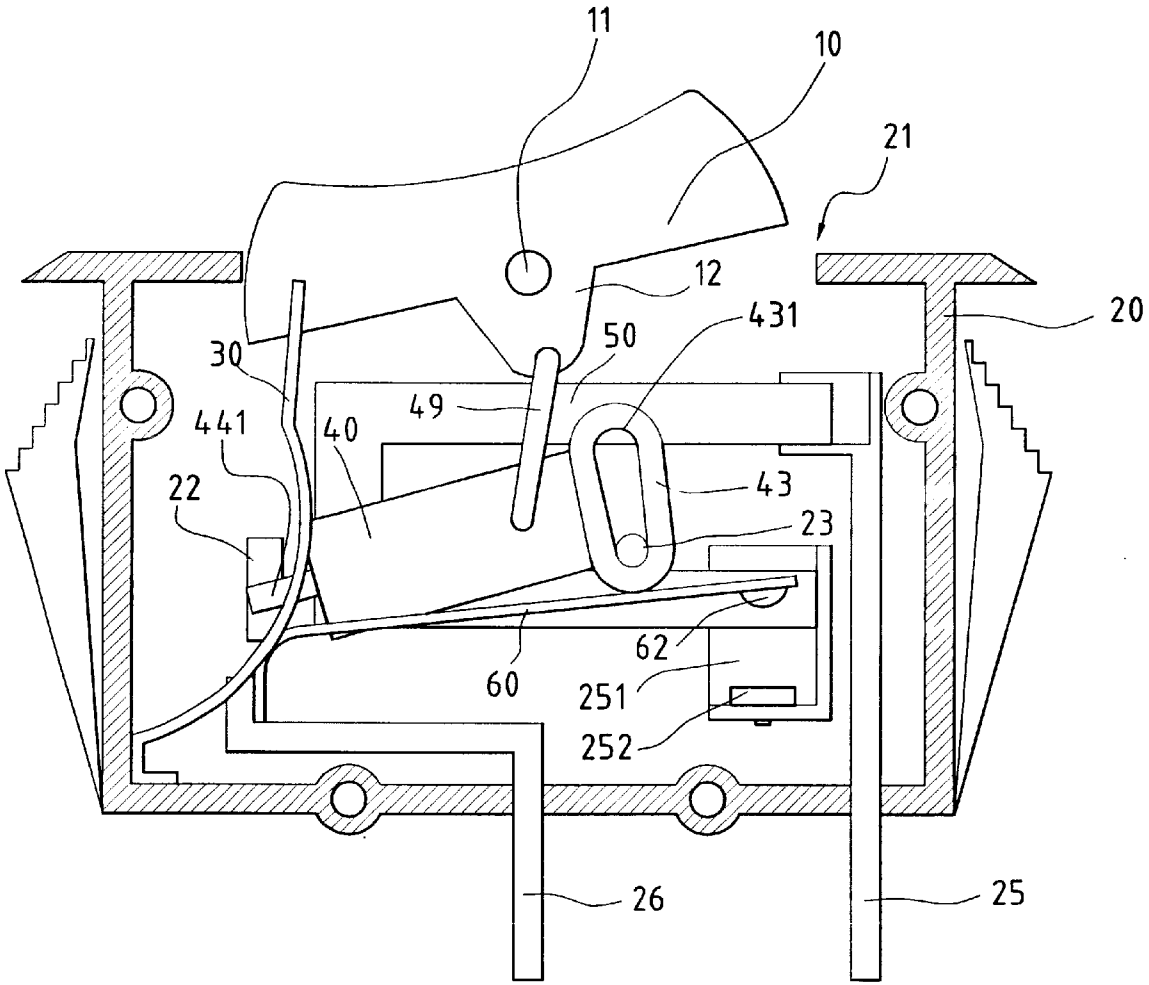
FIG. 4 is a side elevational view, partly in section, of the power switch device of the present invention, wherein the device is shut off when the current is overloaded.

As shown in FIG. 4, when the current is overloaded, the alloy piece 50 is thermally deformed and bends toward the first distal end 442 of the movable member 44 so that the first distal end 442 of the movable member 44 pushes the resilient member 444 and the second distal end 441 is removed from the support plate 22. Once the second distal end 441 of the movable member 44 is not supported by the support plate 22, the switch contact device 40 is pivoted due to the gravity and the head 43 is therefore released from the conductive plate 60 to separate the first contact joint 252 and the second contact joint 62 to shut off the circuit.

The power switch device of the present invention responses rapidly when the current is overloaded. Once the second distal end 441 is removed from the support plate 22, it is reliable that the circuit will not be closed except operators push the switch cover body 10 again.

While we have shown and described various embodiments in accordance with the present invention, it should be clear to those skilled in the art that further embodiments may be made without departing from the scope and spirit of the present invention.

What is claimed is:

1. A power switch device comprising:

a switch body having an open top and a switch cover body pivotably engaged with said open top of said switch body, a first contact terminal and a second contact terminal engaged with a bottom of said switch body, a support plate and a retaining pin respectively extending from an inside of said switch body, a seat connected to said inside of said switch body and having a first contact joint;

a conductive plate having one end thereof fixedly connected to said second contact terminal and the other end of said conductive plate having a second contact joint, a gap defined between said first contact joint and said second contact joint;

an alloy piece having two protrusions and one of said protrusions fixedly connected to said first contact terminal and the other protrusion of said alloy piece connected to said seat;

a switch contact device having a shank and a head on one end of said shank, said head having a slot defined therein and said retaining pin located in said slot, a movable member retractably received in said shank and a first distal end of said movable member contacting said alloy piece and a second distal end movably extending from the other end of said shank, said second distal end being supported on said support plate, a link connected between said shank and said switch cover body, and a contact reed having one end thereof connected to one end of said switch cover body and the other end of said contact reed secured in said switch body.

2. The device as claimed in claim 1, wherein said switch contact device is composed of a first part and a second part, said first part having at least one tube extending from a cooperation surface thereof and toward said second part, said second part having at least one hole defined in a cooperation surface thereof so as to receive said at least one tube.

3. The device as claimed in claim 2, wherein said second part has a recessed portion defined in said cooperation surface thereof, an aperture defined through a bottom defining said recessed portion and a notch defined through a periphery of said recessed portion, said first distal end of said movable member movably received in said aperture, a resilient member biased between said cooperation surface of said first part and said movable member.

4. The device as claimed in claim 1, wherein said bottom of said switch body has two slits defined therethrough so that said first contact terminal and said second contact terminal are respectively engaged with said two slits.

* * * * *